United States Patent [19]

Duczkowski, Jr. et al.

[11] Patent Number: 4,928,602

[45] Date of Patent: May 29, 1990

[54] TRACK CLAMP ASSEMBLY

[75] Inventors: Edward Duczkowski, Jr., South Lyon; Clayton C. McDonald, Howell, both of Mich.

[73] Assignee: Jervis B. Webb Company, Farmington Hills, Mich.

[21] Appl. No.: 319,544

[22] Filed: Mar. 6, 1989

[51] Int. Cl.[5] ..... E01B 25/22; E01B 9/38; B25G 3/20

[52] U.S. Cl. ..... 104/111; 238/281; 403/374

[58] Field of Search ..... 104/93, 111; 105/150; 238/10 A, 10 E, 281; 403/334, 374, 409.1

[56] References Cited

U.S. PATENT DOCUMENTS

| | | | |
|---|---|---|---|
| 1,183,767 | 5/1916 | Radtke | 403/374 X |
| 4,520,733 | 6/1985 | Willmann | 104/93 |
| 4,798,146 | 1/1989 | Roetzel | 104/111 |

FOREIGN PATENT DOCUMENTS

| | | | |
|---|---|---|---|
| 3338840 | 5/1985 | Fed. Rep. of Germany | 104/111 |
| 3533835 | 11/1986 | Fed. Rep. of Germany | 104/111 |
| 0212069 | 3/1924 | United Kingdom | 238/281 |

*Primary Examiner*—Andres Kashnikow
*Assistant Examiner*—Timothy Newholm
*Attorney, Agent, or Firm*—Joseph W. Farley

[57] ABSTRACT

A track clamp assembly for supporting or splicing tracks of I-shaped cross-section formed by a vertical web with horizontal parallel flanges at the opposite ends of the web and having a pair of oppositely facing grooves formed in the flanges on each side of the web. The track clamp assembly comprises upper and lower clamp members respectively having upper and lower edges insertable in a pair of track grooves, and having interengageable ramp surfaces disposed between the upper and lower edges and extending obliquely thereto. Outwardly projecting tabs on the clamp members are engageable by a connecting bolt which when tightened moves the ramp surfaces into interengagement, increasing the dimension between the upper and lower edges and forcing the clamp members into locking engagement with the track.

16 Claims, 1 Drawing Sheet

TRACK CLAMP ASSEMBLY

SUMMARY OF THE INVENTION

This invention relates to an improved track clamp assembly, engageable with a monorail track having an I-shaped cross-sectional configuration, for attaching the track to a supporting member, or for splicing two sections of the track together in end-to-end relation.

Such a monorail track is conventionally formed with a vertical web, with parallel horizontal flanges extending perpendicular to the vertical web at the opposite ends thereof, and with a pair of longitudinally extending oppositely facing grooves provided in the flanges on each side of web. When a track of this type is used, for example in an overhead monorail system, one pair of grooves is employed in attaching the track to suitable, longitudinally spaced track supporting members as shown by U.S. Pat. No. 4,798,146; the other pair of grooves may be used in the mounting of conductor bars on the track for supplying electrification to self-propelled vehicles supported and guided thereby.

The present invention provides a track clamp assembly, useable for either supporting or splicing a track of the type described above, and which simplifies the configuration of the track supporting members, compensates for dimensional variations in the track resulting from manufacturing tolerances, facilitates the installation of the track, and engages the track with a controllable locking action.

This track clamp assembly of the invention comprises an upper clamp member having an upper edge extending longitudinally of the track a desired distance and insertable in the upper groove of a pair of grooves on one side of the vertical web of the track, and a lower clamp member having a lower edge extending longitudinally of the track a corresponding distance and insertable in the lower groove of the same pair of grooves. These upper and lower clamp members are provided with opposed interengageable ramp surfaces disposed intermediate their upper and lower edges, and are connected to each other, with their upper and lower edges respectively inserted in the upper and lower grooves of one pair of grooves, by connecting means which places the ramp surfaces in engagement and which is adapted to relatively move the clamp members along the ramp surfaces. In response to such relative movement, the transverse dimension of the track clamp assembly is increasable, thereby forcing the upper and lower edges of the clamp members into firm clamped engagement with the track within the one pair of grooves, thus locking the track clamp assembly to the track.

Preferably the ramp surfaces extend longitudinally of the track and obliquely to the upper and lower edges of the clamp members, are formed as V-shaped guides, and are brought into engagement by relative longitudinal movement between the clamp members, such movement also being imparted by the connecting means consisting of a single bolt and nut connection extending through outwardly projecting tabs on the clamp members, so that the locking action depends upon the extent to which the bolt and nut connection is tightened. One of the projecting tabs, preferably the one on the upper clamp member, also forms a bracket for attaching that clamp member to a track supporting member.

Other features and advantages of the invention will appear from the description to follow of the presently preferred embodiment shown in the accompanying drawings.

DESCRIPTION OF THE PREFERRED EMBODIMENT

Figure 1:
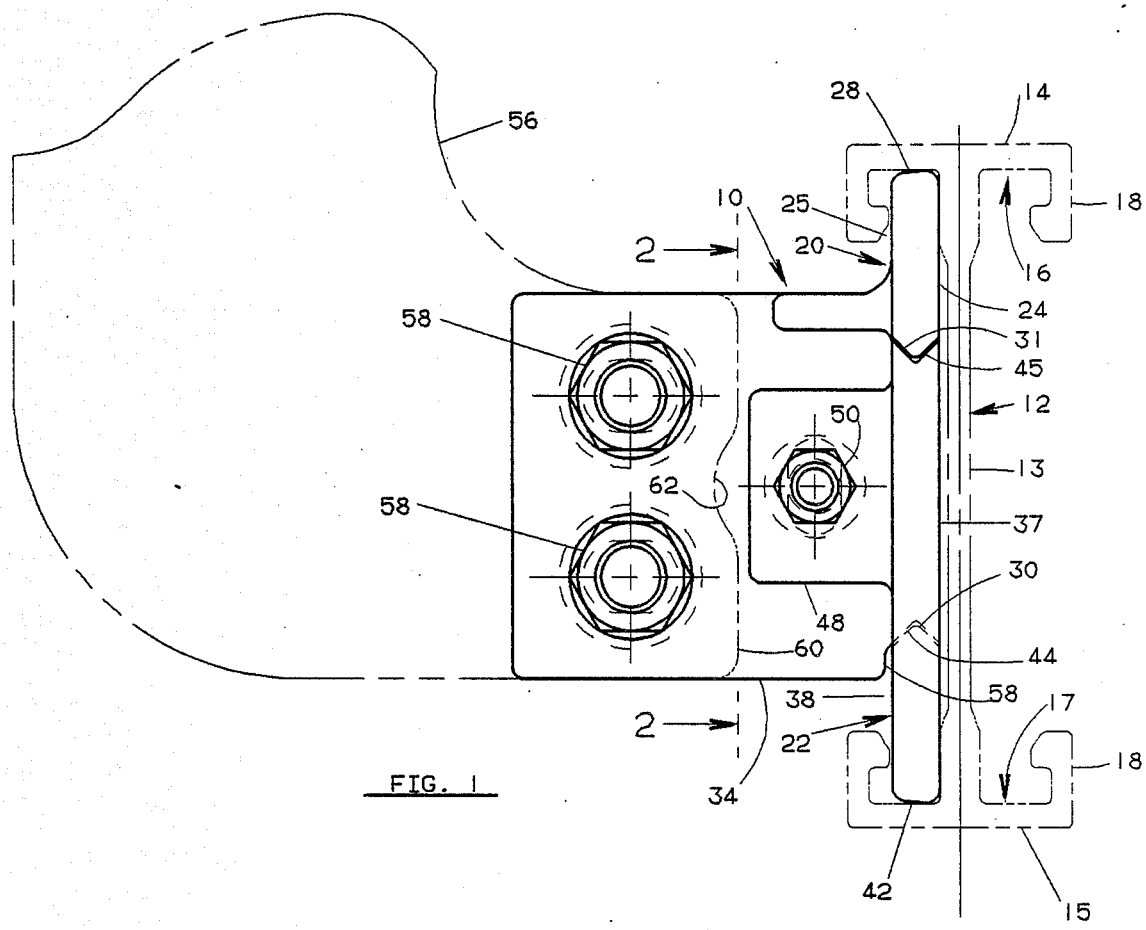
FIG. 1 is an end elevation showing a track clamp assembly of the invention in engagement with an I-section track and connected to a track supporting member; and, FIG. 2 is a side elevation of the track clamp assembly, taken as indicated by the line 2—2 of FIG. 1 in order to eliminate the track supporting member from this view for the sake of clarity.
Figure 2:
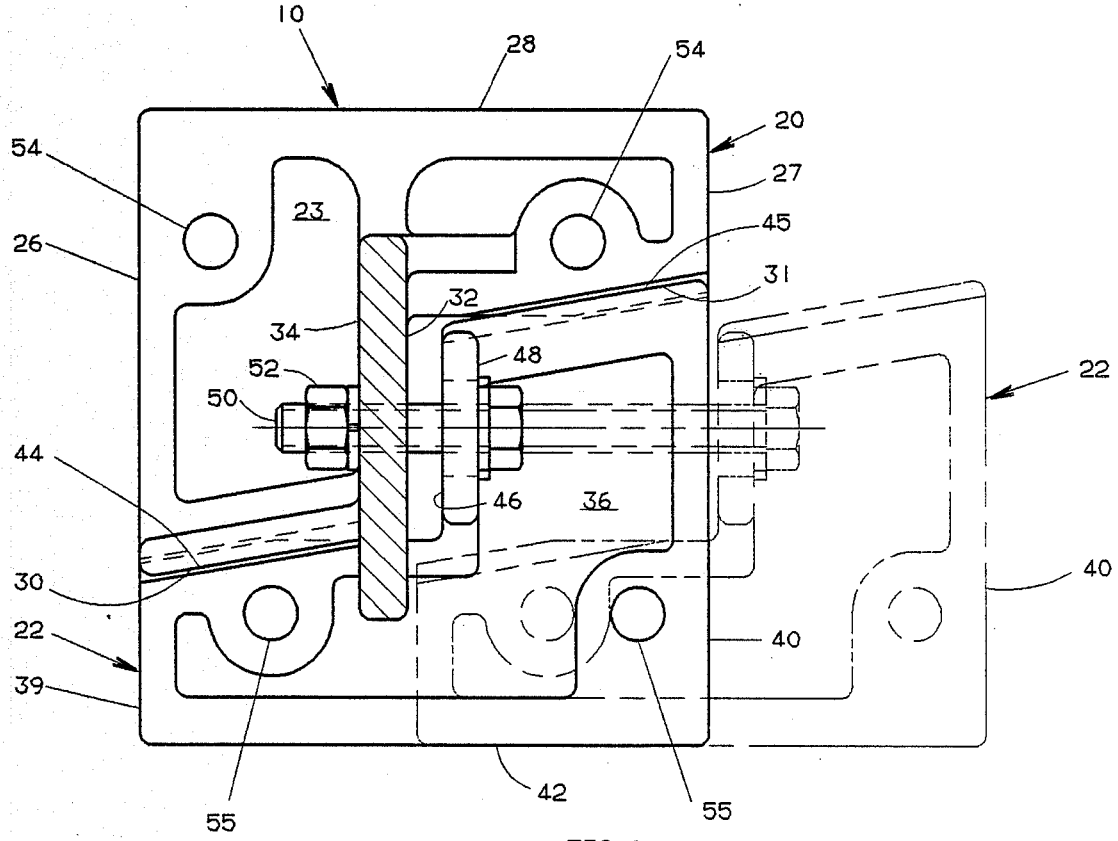

In FIGS. 1 and 2, a track clamp assembly 10 of the invention is shown in engagement with a track 12 having an I-shaped cross-sectional configuration formed by a vertical web 13 and upper and lower parallel horizontal flanges 14 and 15 at the opposite ends of the web 13. A pair of oppositely facing upper and lower grooves 16 and 17 extend longitudinally of the track 12 on each side of the web 13 at the junction between the web 13 and the flanges 14 and 15. As shown, the grooves 16 and 17 are defined by portions 18 which project from the flanges 14 and 15 in facing relation to each other and in parallel spaced relation with the web 13 on each side thereof. Tracks having a cross-sectional configuration of this general type are conventionally employed in monorail systems in which wheels of a self-propelled vehicle are supported on the upper flange 14 and guided by the flange portions 18.

The track clamp assembly 10 is composed of an upper clamp member 20 and a lower clamp member 22 which are substantially configured correspondingly and oppositely to each other. The upper clamp member has a plate-like main portion or body 23 define by an inner face 24 and an outer face 25; by parallel, longer and shorter ends 26 and 27 spaced apart a desired distance longitudinally of the track 12; by an upper edge 28 extending linearly between the upper extremities of the ends 26 and 27 perpendicular thereto; and by ramp surfaces 30 and 31 disposed between the lower extremities of the ends 26 and 27 and offset by a surface 32 which is parallel to the ends and which forms part of a tab or bracket 34 projecting from and normal to the outer face 25. Ramp surfaces 30 and 31 extend obliquely to the upper edge 28 and are formed as oppositely facing V-shaped guides (FIG. 1). The upper edge 28 is insertable in one of the upper grooves 16 of the track 12.

The corresponding, oppositely configured lower clamp member 22 has a plate-like body 36 with an inner face 37, an outer face 38, parallel shorter and longer ends 39 and 40, a lower edge 42 extending linearly between the lower extermities of the ends, and ramp surfaces 44 and 45 disposed between upper extremities of the ends 39 and 40 and offset by a surface 46 forming part of a tab 48 which projects from the outer face 38 and which is smaller than the bracket 34 of the upper clamp member 20. Ramp surfaces 44 and 45 extend obliquely to the lower edge 42, and are also formed as oppositely facing V-shaped guides, respectively complementary to the ramp surfaces 30 and 31 of the upper clamp member 20. The lower edge 42 is insertable in one of the lower grooves 17 of the track 12, which lower groove forms with one of the upper grooves 16 a pair of grooves on one side of the web 13 of the track.

As shown in FIG. 1, the lower edge 42 of the lower clamp member 22 is a tapered surface inclined upwardly toward the outer face 38 of the member 22; likewise, the upper edge 28 of the upper clamp member 20 is oppositely tapered, being inclined downwardly toward the outer face 25 of the member 20. The edges 28 and 42 thus outwardly converge.

A connecting bolt 50 extends longitudinally or lengthwise of the clamp assembly 10 through holes in the tab 48 of the lower clamp member 22 and in the bracket 34 of the upper clamp member 20 for connecting the clamp members together in assembled relation engaging the track 12. This connection is made by first positioning the upper clamp member 20 with its inner face against one side of the vertical web 13 of the track 12 and with its upper edge 28 inserted in the upper groove 16 of the pair of grooves on that side of the vertical web 13. The lower clamp member 22 is positioned to the right of the upper clamp member (as shown in broken line in FIG. 2), is placed with its inner face 37 adjacent to the vertical web 13 of the track 12 and with its lower edge 42 inserted into the lower groove 17 of the pair of grooves. Then, the clamp members 20 and 22 are relatively moved toward each other so that the end 39 and adjacent portion of the outer face 38 of the lower clamp member 22 pass inside of a notch 58 (FIG. 1) on the bracket 34 of the upper clamp member 20. Opposed ramp surfaces 30 and 31 on the upper clamp member 20 and 44 and 45 on the lower clamp member 22 are brought into interengagement, the connecting bolt 50 is installed, and a nut 52 is threaded onto the bolt 50. Tightening of the bolt and nut connection produces endwise closing relative movement between the clamp members 20 and 22 along their ramp surfaces 30, 31 and 44, 45. As shown in FIG. 2, these ramp surfaces are arranged so as not to unduely restrict such endwise relative movement. The ramp surface 44 on the lower clamp member has a length less than that of the upper ramp surface 30 which it engages, the ramp surface 44 terminating in a non-oblique surface 44A extending to the offset surface 46. Likewise, the upper ramp surface 31 has a length less than its complementary lower ramp surface 45 and terminates in a non-oblique surface 31A extending to the offset surface 32. Offset surfaces 32 and 46 are spaced endwise to provide a range of endwise movement between the clamp members.

The endwise closing relative movement of the camp members 20 and 22 along their ramp surfaces 30, 31 and 44, 45 results in increasing the dimension between their upper and lower edges 28 and 42 and places these edges into firm locking engagement with the track to an extent controllable by the degree to which the bolt and nut connection 50, 52 is tightened.

Forces on the track 12 resulting from this engagement are applied closely adjacent to the root or base of the web 13, rather than to the midpoint of the flanges 14 and 15, due to the outward convergence of the edges 28 and 42 of the clamp members. The engagement so obtained between the clamp assembly 10 and the track 12 is sufficiently positive as to enable the clamp assembly to be employed as a splice or connection between adjacent end-to-end sections of the track 12.

Pairs of holes 54 in the upper clamp member 20 and 55 in the lower clamp member 22 permit the optional bolting of the assembly 10 to the track 12 by drilling corresponding holes in the track web 13 after the assembly 10 has been installed as described above.

FIG. 1 illustrates in broken line a track supporting member 56 and means comprising a pair of bolts 58 for attaching the bracket 34 of the upper clamp member 20 of the clamp assembly 10 to the track supporting member. This attachment of the upper clamp member 20 to the track supporting member 56 can be made prior to the installation of the track 12. When a series of upper clamp members 20 have been so attached to a series of track supporting members, a section of the track 12 can be hung on the upper clamp members 20 and positioned thereby at proper elevation while a lower clamp member 22 is installed on each of the series of upper clamp members. The track supporting member 56 can be simply formed from plate stock and can be attached to either side of the upper clamp member bracket 34. The lower terminal end 60 of the supporting member 56 is provided with a recess 62 for clearance in the installation of the connecting bolt 50 and nut 52.

The clamp assembly 10 thus has the advantages of minimal assembly time; of providing an accurate support for the track 12 during the installation thereof; of providing a positive locking engagement with the track member that compensates for dimensional tolerances and that applies forces to the track member adjacent to its vertical web; and, of maintaining alignment between the upper and lower clamp members 20 and 22 both during and after their assembly by the interengagement of their opposing, V-shaped guides of the ramp surfaces 30, 31 and 44, 45.

We claim:

1. A track clamp assembly engageable with a track having an I-shaped cross-sectional configuration formed by a vertical web with parallel horizontal flanges extending perpendicular thereto and having a pair of longitudinally extending oppositely facing grooves provided in the flanges on at least one side of the web adjacent to the junctions between the web and the flanges, said track clamp assembly comprising:

an upper clamp member having parallel ends spaced apart a desired distance longitudinally of said track, one end being longer than the other end, an upper edge extending between the upper extremities of said ends, and upper ramp surface means disposed between the lower extremities of said ends, said upper ramp surface means facing oppositely from said upper edge and extending obliquely relative thereto, said upper edge being insertable in the upper groove of the pair of grooves on said one side of the vertical web of the track;

a lower clamp member, said lower clamp member having shorter and longer ends arranged oppositely to said upper member ends, a lower edge extending between the lower extremities of of said shorter and longer ends, and lower ramp surface means disposed between the upper extremities of said shorter and longer ends, said lower ramp surface means facing oppositely from and extending obliquely to said lower edge in complementary relation to said upper ramp surface means, said lower edge being insertable in the lower groove of said pair of grooves on said one side of the vertical web of the track; and means for forcing said upper and lower edges into clamped engagement with the track comprising connecting means securing said upper and lower clamp members to each other with their said upper and lower edges respectively inserted in the upper and lower grooves of said pair of grooves, and with their said upper and lower ramp surface means in interengagement, said connecting means being operable to relatively move said clamp members together along said upper and lower ramp surface means, the width dimension of said track clamp assembly between said upper and lower edges being increasable in response to such relative movement.

2. A track clamp assembly according to claim 1 wherein said upper and lower ramp surface means are formed as interengageable V-shaped guides.

3. A track clamp assembly according to claim 2 wherein said upper and lower ramp surface means each comprise two parallel ramp surfaces offset from each other widthwise of the track clamp assembly intermediate the ends of their respective upper and lower clamp members.

4. A track clamp assembly according to claim 3 wherein said two parallel offset ramp surfaces of each of said upper and lower ramp surface means are spaced from each other in an endwise direction at their offset.

5. A track clamp assembly according to claim 1 wherein said upper and lower clamp members each have an inner face adapted to be positioned adjacent to the said vertical web of the track, an outer face, and said upper and lower edges of said clamp members converge toward the outer faces thereof.

6. A track clamp assembly according to claim 1 wherein said connecting means comprises a threaded connector and bracket means on each of said upper and lower clamp members engageable by said connector said bracket means projecting transversely of the track from said clamp members.

7. A track clamp assembly according to claim 1 further comprising means for attaching one of said upper and lower clamp members to a track supporting member.

8. A track clamp assembly according to claim 7 wherein said attaching means comprises a bracket provided on said upper clamp member, said bracket projecting outwardly of said upper clamp member in a direction substantially transversely to said track.

9. A track clamp assembly according to claim 8 wherein said connecting means includes a tab provided on said lower clamp member and adapted to be positioned in parallel spaced relation with said bracket in the assembled relation of said upper end lower clamp members, and a connector adjustably engageable with said bracket and said tab.

10. A track clamp assembly engageable with a track having an I-shaped cross-sectional configuration formed by a vertical web with parallel horizontal flanges extending perpendicular thereto at opposite ends thereof and having a pair of longitudinally extending oppositely facing grooves provided in the flanges on each side of the web adjacent to the junctions between the web and the flanges, said track clamp assembly comprising:

an upper clamp member having an upper edge insertable in the upper groove of the pair of grooves on one side of the vertical web of the track, a lower clamp member having a lower edge insertable in the lower groove of said pair of grooves on one side of the vertical web of the track, said upper and lower clamp members having opposed interengageable ramp surface means disposed intermediate said upper and lower edges, and means for forcing said upper and lower edges into clamped engagement with the track comprising connecting means securing said upper and lower clamp members to each other with their said upper and lower edges respectively inserted in the upper and lower grooves of said pair of grooves, and with their said upper and lower ramp surface means in interengagement, said connecting means being operable to relatively move said clamp members together along said upper and lower ramp surface means, the width dimension of said track clamp assembly between said upper and lower edges being increasable in response to such relative movement.

11. A track clamp assembly according to claim 10 wherein said connecting means comprises a first connecting portion formed with said upper clamp member, a second connecting portion formed with said lower clamp member, said connecting portions projecting from said upper and lower clamp members transversely of the track, and a connector extending longitudinally of the track through said connecting portions.

12. A track clamp assembly according to claim 11 wherein said first connecting portion includes a bracket adapted to be attached to a track supporting member.

13. A track clamp assembly according to claim 11 wherein said interengageable ramp surface means comprises at least one downwardly facing surface on said upper clamp member and at least one upwardly facing surface on said lower clamp member, said downwardly and upwardly facing surfaces extending longitudinally of the track and obliquely to said upper and lower edges.

14. A track clamp assembly according to claim 11 wherein said interengageable ramp surface means comprises two sets of downwardly facing and upwardly facing surfaces formed respectively on said upper and lower clamp members, one of said sets of surfaces being spaced longitudinally and transversely of said clamp members from the other of said sets of surfaces, and said sets of surfaces extending longitudinally of the track and obliquely to said upper and lower edges.

15. A track clamp assembly according to claim 14 wherein one surface of each of said sets of surfaces is longitudinally shorter than the other surface of that set.

16. A track clamp assembly according to claim 15 wherein each of said sets of surfaces is formed as interengageable V-shaped guides.

* * * * *

UNITED STATES PATENT AND TRADEMARK OFFICE

CERTIFICATE OF CORRECTION

PATENT NO. : 4,928,602

DATED : May 29, 1990

INVENTOR(S) : Edward Duczkowski et al.

It is certified that error appears in the above-identified patent and that said Letters Patent is hereby corrected as shown below:

Column 2, line 38, "define" should read --defined--

Column 3, line 48, "camp" should read --clamp--

Signed and Sealed this

First Day of October, 1991

*Attest:*

*Attesting Officer*

HARRY F. MANBECK, JR.

*Commissioner of Patents and Trademarks*